US009259104B2

(12) United States Patent
Yuen

(10) Patent No.: US 9,259,104 B2
(45) Date of Patent: Feb. 16, 2016

(54) ELECTRIC DISPLAY APPARATUS WITH A LIGHTING SYSTEM

(71) Applicant: DongGuan HengLong Fixture Manufacturing Company LTD, Dongguan (CN)

(72) Inventor: Ho Yeung Yuen, Dongguan (CN)

(73) Assignee: DongGuan HengLong Fixture Manufacturing Company, Ltd., Dongguan (CN)

( * ) Notice: Subject to any disclaimer, the term of this patent is extended or adjusted under 35 U.S.C. 154(b) by 212 days.

(21) Appl. No.: 14/076,277

(22) Filed: Nov. 11, 2013

(65) Prior Publication Data

US 2015/0059160 A1 Mar. 5, 2015

(30) Foreign Application Priority Data

Aug. 29, 2013 (CN) ..... 2013 2 0529848

(51) Int. Cl.

| | |
|---|---|
| ***A47F 5/04*** | (2006.01) |
| ***H01R 25/14*** | (2006.01) |
| ***A47F 5/08*** | (2006.01) |
| ***A47F 5/10*** | (2006.01) |
| ***A47B 96/14*** | (2006.01) |
| *F21W 131/301* | (2006.01) |
| *F21Y 103/00* | (2006.01) |

(52) U.S. Cl.

CPC . *A47F 5/04* (2013.01); *A47B 96/14* (2013.01); *A47B 96/1475* (2013.01); *A47F 5/0838* (2013.01); *A47F 5/101* (2013.01); *H01R 25/147* (2013.01); *A47B 2220/0077* (2013.01); *F21W 2131/301* (2013.01); *F21Y 2103/00* (2013.01); *Y10T 29/49002* (2015.01)

(58) Field of Classification Search

CPC ..... A47B 96/14; A47B 96/1475; A47B 96/1483; A47B 2220/0077; A47F 5/04; A47F 5/0803; A47F 5/101; H01R 25/147; F21Y 2103/00; F21W 2132/301

See application file for complete search history.

(56) References Cited

U.S. PATENT DOCUMENTS

| | | | | |
|---|---|---|---|---|
| 5,226,724 | A * | 7/1993 | Kanarek | F21S 2/00 362/151 |
| 5,420,763 | A * | 5/1995 | Vanderhoof | B60Q 3/025 362/223 |
| 6,454,431 | B1 * | 9/2002 | Grossman | F21S 2/00 362/150 |
| 7,314,295 | B2 * | 1/2008 | Legat | F21V 15/01 362/223 |
| 7,695,157 | B2 * | 4/2010 | Yaphe | F21V 15/013 362/147 |
| 2006/0162202 | A1 * | 7/2006 | Landry | G09F 1/08 40/541 |

* cited by examiner

*Primary Examiner* — Carl Arbes
(74) *Attorney, Agent, or Firm* — Brundidge & Stanger, P.C.

(57) ABSTRACT

The electric display apparatus with a lighting system, comprising: an electric display column, a support frame, a display shelf, some lamps, some plastic strips and coppers. The electric display column includes some grooves and grids. The plastic strips are installed in the grooves; the coppers are installed in the plastic strips, and they are connected to the power supply. The multiple rectangular hanging holes distributing along the longitudinal direction of the grids; the hanging arms are installed on both ends of the support frame. The middle part of the hanging arm is installed with the guide groove, which bottom installed the positioning bolt. The insulating plastic material movable plug is fixed in the hanging arms, the interior of the movable plug inlaid with the electric copper, which is installed in the guide groove of the hanging arm. The display shelf is fixed to the support frame by the screw connection.

6 Claims, 8 Drawing Sheets

ELECTRIC DISPLAY APPARATUS WITH A LIGHTING SYSTEM

FIELD OF THE INVENTION

An aspect of the present invention relates to a display stand. More particularly, the described technology relates to an electric display apparatus with a lighting system.

DESCRIPTION OF THE RELATED ART

In recent years, the display apparatus, which the inventor developed in the past, is installed with the lamps on its display shelf, but the lamp of every display shelf isn't equipped with the independent switch, the users can only control the main power switch to turn on or off the lamps of the display shelf together, but they aren't free to control every independent lamp of the display shelf being on or off. This will cause a lot of waste of the electrical resources.

SUMMARY OF THE INVENTION

Aspects of the present invention provide an electric display apparatus with a lighting system, which can overcome the problem, of independent switch controlling every lamp of the display shelf, in order to save on electrical resources.

The advantage can be achieved by the following invention.

The electric display apparatus with a lighting system of the present invention, comprising: electric display column, support frame, display shelf, lamps, plastic strips and coppers.

The said electric display column includes grooves and grids. The said plastic strips are installed in the grooves, to play a role in insulation; the said coppers are installed in the plastic strips, and they are connected to the power supply. Which the left copper is connected the positive pole of the power supply, and the right one is connected the negative pole of the power supply. There are multiple rectangular hanging holes distributing along the longitudinal direction of the grids; the grooves and grids can be divided into two forms of single and double grooves and grids. The shapes of the electric display column can be three forms of inverted mountain type strip, circular and square column. The inverted mountain type strip one is installed the bayonet; both sides of the circular column are symmetrically distributed two back to back double grooves and grids, in order to take full advantage of the both sides; and the square column is the same with the circular one.

Both ends of the said support frame are installed the hanging arms, which top is installed a hook, the hook is installed in the rectangle hanging hole of the electric display column, and the middle part of the hanging arm is installed the guide groove, which bottom installed the positioning bolt. The insulating plastic material movable plug is fixed in the hanging arms, the interior of the said movable plug inlaid with the electric copper, which is installed in the guide groove of the hanging arm, and which can be moved back and forth. There is a guide hole on the corresponding position of the movable plug and hanging arm. The positioning bolt is fixed in the guide hole, in order to connect the movable plug and hanging arm, the movable plug can move back and forth in the limited range of the guide hole. The length of the guide hole depends on if the electric copper of the movable plug can full contact and out to the coppers of electric display column. And the electric copper of the left movable plug is connected to the positive pole of lamps, the right one is connected to the negative pole. The wires and lamps are installed in the support frame, and the said lamps are covered by the transparent masks.

The said display shelf is fixed to the support frame by the screw connection.

In the above method, the electric display column can be connected to the support frame by the hanging arms, and the interior of the electric display is installed the electric copper, which is connected to the power supply, there is an insulating plastic material movable plug is installed in the hanging arm of support frame, and there is also installed the electric copper in the movable plug, the electric copper of the left movable plug is connected to the positive pole of lamps, the right one is connected to the negative pole. When the users want to turn on or off the independent lamps of the display shelf, they just need push the movable plug to move back or forth, in order to make the electric copper of the movable plug can be full touched on or not to the electric copper of electric display column. The advantage of the present invention is that it can overcome the problem of independent switch controlling every lamp of the display shelf, and it can achieve to save the resources, it's more environmental protection and energy conservation.

Figure 1:
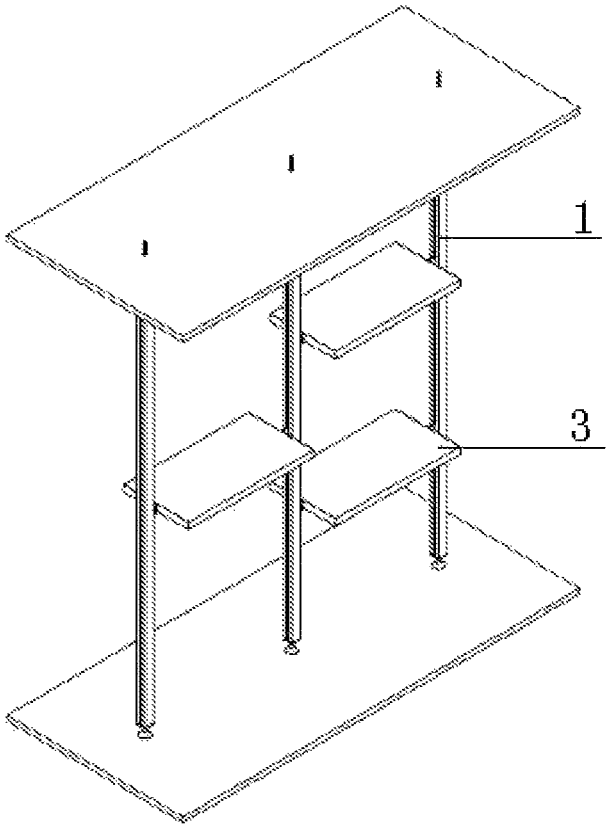
FIG. 1 is the schematic view of the electric display column which is in independently used.
Figure 2:
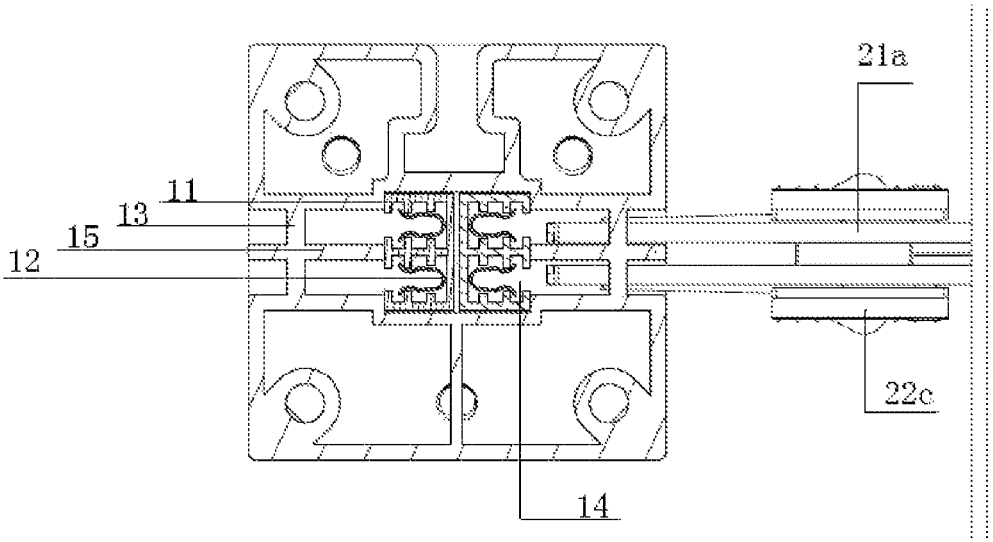
FIG. 2 is the cross-sectional schematic view of the square column electric display column which is connected with the movable plug.
Figure 3:
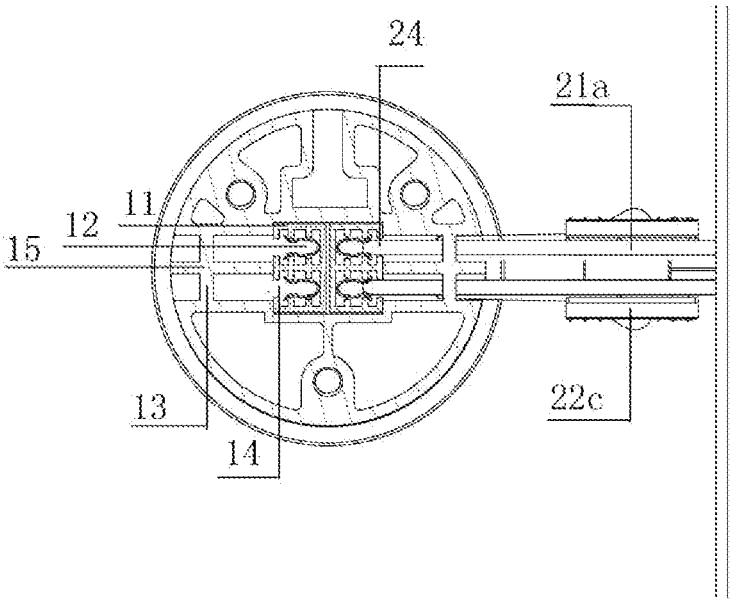
FIG. 3 is the cross-sectional schematic view of the circular column electric display column which is connected with the movable plug.
Figure 4:
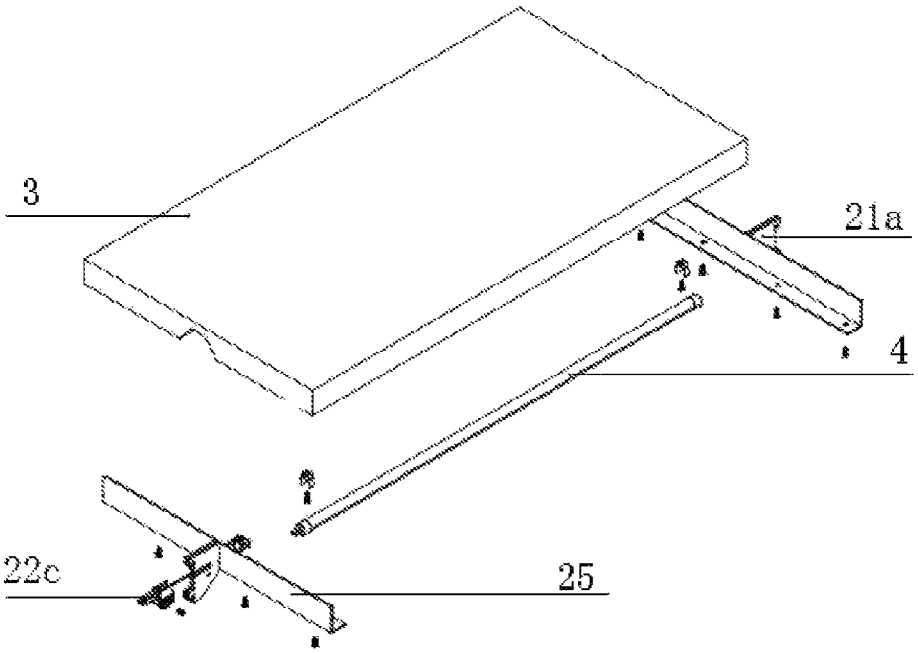
FIG. 4 is the exploded View of the electric display column which is in independently used.
Figure 5:
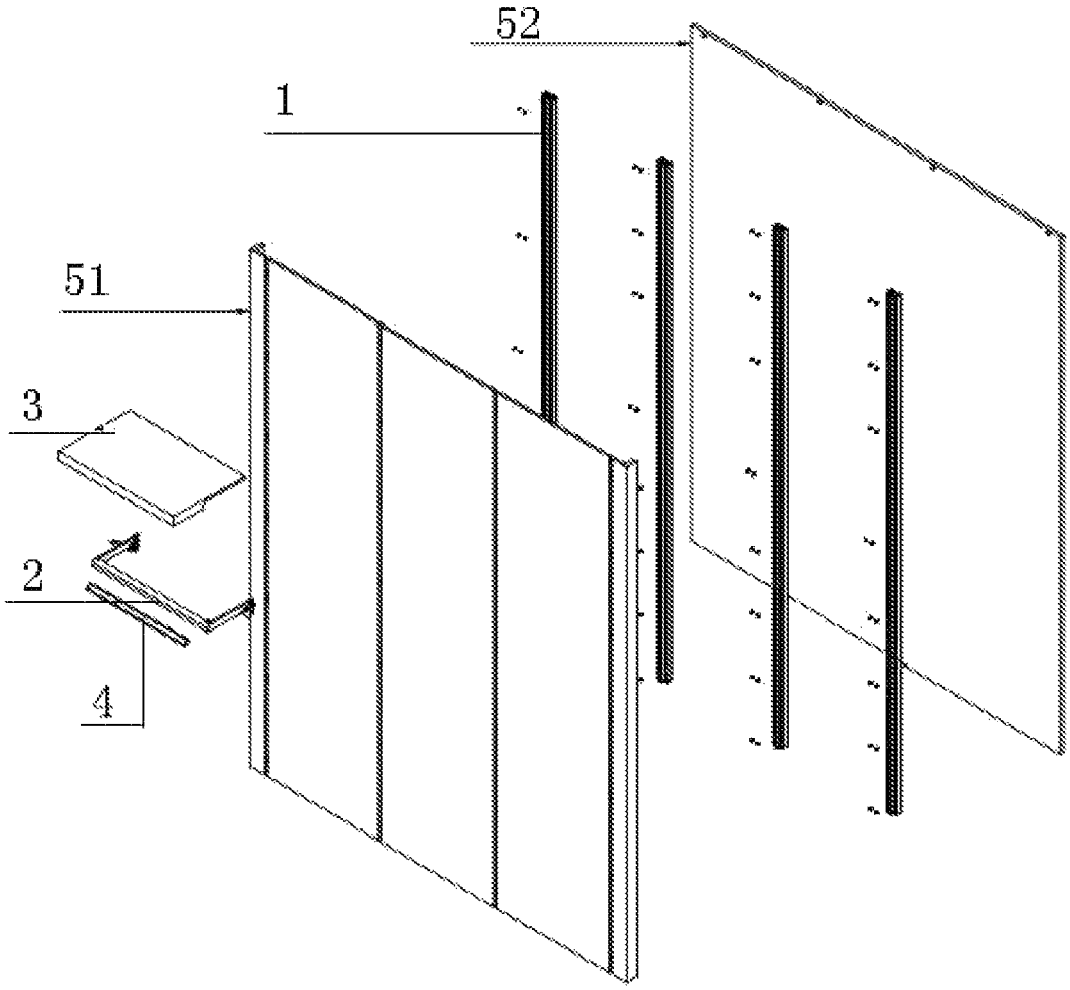
FIG. 5 is the exploded View of the electric display column which is fixed on the wall.
Figure 6:
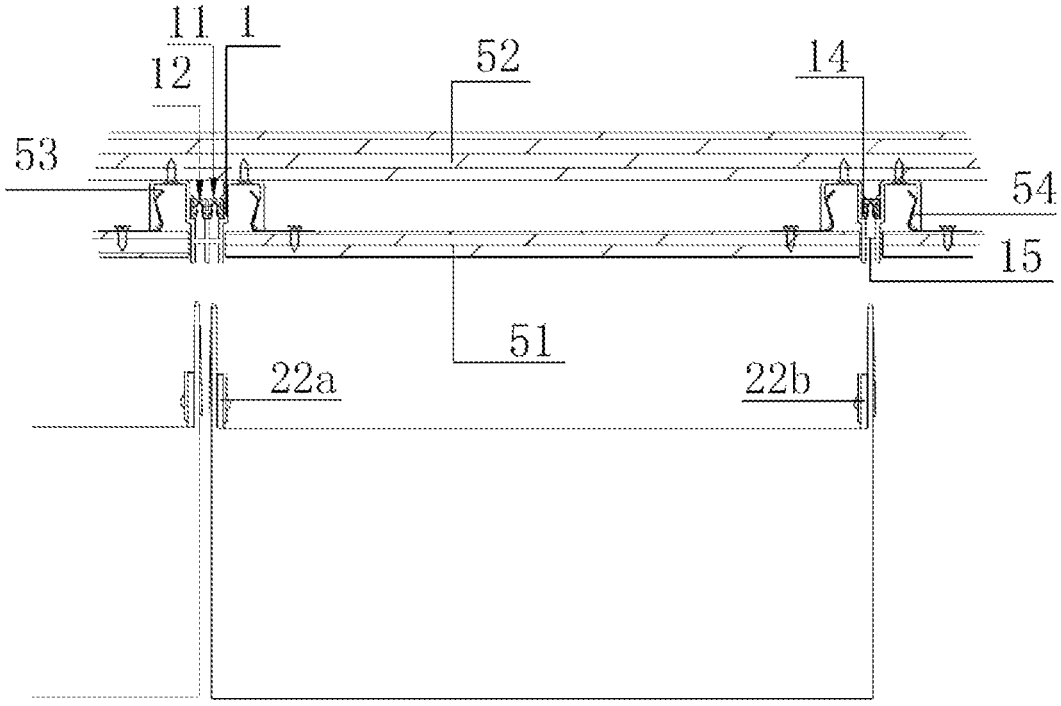
FIG. 6 is the cross-sectional schematic view of the inverted mountain type strip electric display column with single movable plug.
Figure 7:
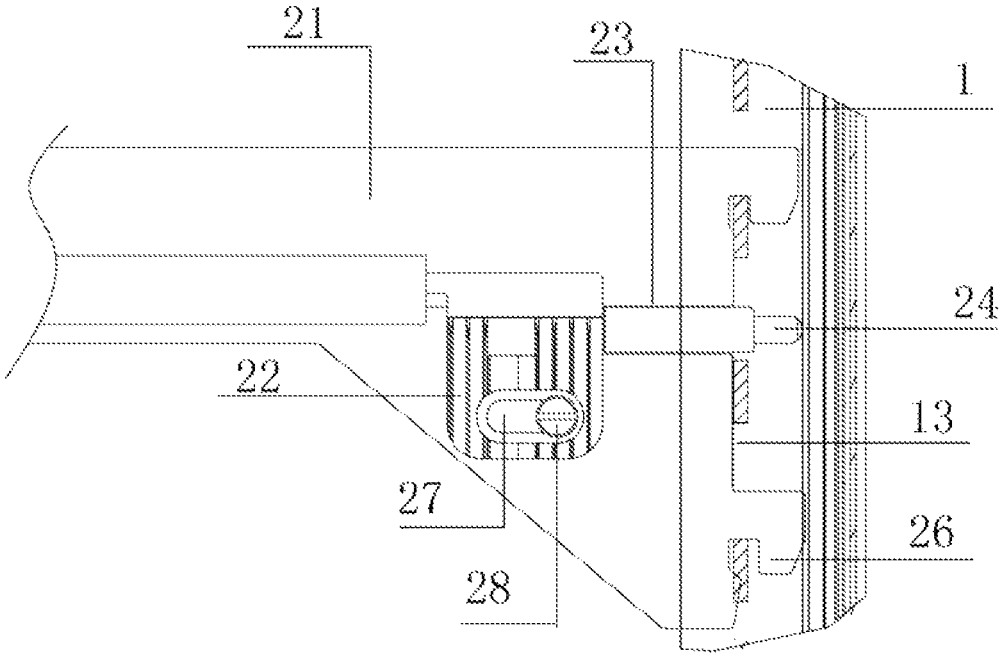
FIG. 7 is the cross-sectional schematic view of the support frame which is connected with the electric display column.
Figure 8:
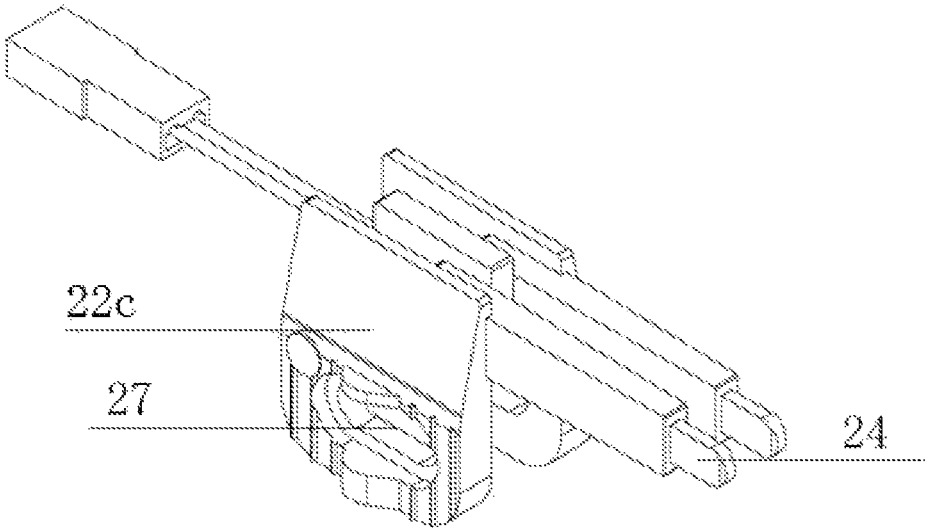
FIG. 8 is the schematic view of the double movable plugs.

Namely, 1-electric display column; 2-support frame; 3-display shelf; 4-lamp; 11-plastic strips; 12-copper; 13-rectangle hanging hole; 14-groove; 15-grid; 21-hanging arm; 21*a*-double-hanging arms; 22-movable plug; 22*a*-left movable single plug; 22*b*-right movable single plug; 22*e*-movable double plugs; 23-guide groove; 24-electric copper; 25-bracket; 26-hook; 27-guide hole, 28-positioning bolt; 51-display panel; 52-fixed panel; 53-flange collar; 54-bayonet.

DETAILED DESCRIPTION OF THE DRAWINGS

The present invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

In order to clarify the present invention, elements extrinsic to the description are omitted from the details of this description, and like reference numerals refer to like elements throughout the specification.

In several exemplary embodiments, constituent elements having the same configuration are representatively described in a first exemplary embodiment by using the same reference numeral and only constituent elements other than the constituent elements described in the first exemplary embodiment will be described in other embodiments.

The First Exemplary Embodiment

When the electric display column 1 is used dependently, the fixed panel 52 will be fixed on the wall at first, the electric display column 1 is fixed on the fixed panel 52. The electric display column 1 is a shape of inverted mountain type strip, and it includes grooves 14 and grids 15. The plastic strips 11 are installed in the grooves 14, the coppers 12 are installed in the plastic strips 11, and they are connected to the power supply. There are multiple rectangular hanging holes distributing along the longitudinal direction of the grids 15; the grooves 14 and grids 15 can be divided into two forms of single and double grooves 14 and grids 15, the electric display column 1 is, installed the bayonet 54, and the display panel 51 is equipped the flange collar 53, the display panel 51 is clamped and fixed on the electric display panel 51 by the flange collar 53 and bayonet 54.

Both ends of the said support frame 2 are installed the hanging arms 21, the insulating plastic material movable plug 22 is fixed in the hanging arms 21, the wires and lamps 4 are installed in the support frame 2, and the said lamps 4 are covered by the transparent masks. The top of the hanging arm 21 is installed a hook 26, the hook 26 is installed in the rectangle hanging hole 13 of the electric display column 1, and the middle part of the hanging arm 21 is installed the guide groove 23, which bottom is installed the positioning bolt 28. The movable plug 22 is fixed in the hanging arms 21, the interior of the said movable plug 22 is inlaid with the electric copper 24, which is installed in the guide groove 23 of the hanging arm 21, and which can be moved back and forth. There is a guide hole 27 on the corresponding position of the movable plug 22 and hanging arm 21. The positioning bolt 28 is fixed in the guide hole 27, in order to connect the movable plug 22 and hanging arm 21, the movable plug 22 can move back and forth in the limited range of the guide hole 27. The length of the guide hole 27 depends on if the electric copper 24 of the movable plug 22 can be full touched on and not to the electric copper 24 of electric display column 1. And the electric copper 24 of the left movable plug 22*a* is connected to the positive pole of lamps 4, the right one is connected to the negative pole. When the electric display column 1 is with double grids 15 and grooves 14, the hanging arms 21 which is with the double-hanging arms 21*a* are one-to-one correspondence with the movable plug 22 which with the movable double plugs 22*c*. Because the double-hanging arms 21*a* is consisted of two same hanging arms 21, you can see the above way also can think that the hanging arm 21 is equipped the left movable plug 22*a*, and the other hanging arm 21 is equipped the right movable plug 22*b*, and they are one-to-one correspondence. The support frame 2 is hitched in the rectangle hanging hole 13 of the electric display column 1 by the hanging arm 21, you just need move the movable plug 22 back and forth to make the electric copper 24 inserting or pulling out from the electric copper 24 of the electric display column 1, in order to turn on or off the lamps 4.

The said display shelf 3 is fixed on the support frame 2 by screws.

The Second Exemplary Embodiment

The electric display column 1 is a shape of circular column, and includes grooves 14 and grids 15. The plastic strips 11 are installed in the grooves 14, the coppers 12 are installed in the plastic strips 11, and they are connected to the power supply. There are multiple rectangular hanging holes distributing along the longitudinal direction of the grids 15; the two groups double grooves 14 and double grids 15, they are distributed symmetrically on both sides of the circular column 1 by ways of back to back.

One side of the support frame 2 is the double-hanging arms 21*a*, which consists of the two same hanging arms 21, the insulating plastic material movable double plugs 22*c* are fixed in the double-hanging arms 21*a*; the other side of the support frame 2 is just with the double-hanging arms 21*a*. The lamps 4 are fixed on the bracket 25 of the support frame 2, and the wires are hided into the body of support frame 2. The top of the double-hanging arms 21*a* is installed a hook 26, the hook 26 is installed in the hanging hole 13 of the electric display column 1, and the middle part of the hanging arm 21 is installed the guide groove 23, which bottom is installed the positioning bolt 28. The movable double plugs 22*c* are fixed in the double-hanging arms 21*a*, the interior of the said movable double plugs 22*c* is inlaid with the electric copper 24, which is installed in the guide groove 23 of the double-hanging arms 21*a*, and they can be moved back and forth. There is a guide hole 27 on the corresponding position of the movable double plugs 22*c* and double-hanging arms 21*a*. The positioning bolt 28 is fixed in the guide hole 27, in order to connect the movable double plugs 22*c* and double-hanging arms 21*a*, the movable double plugs 22*c* can be moved back and forth in the limited range of the guide hole 27. The length of the guide hole 27 depends on if the electric copper 24 of the movable double plugs 22*c* can be full touched on and not to the electric copper 24 of electric display column 1. And the electric copper 24 of the left movable plug 22*a* is connected to the positive pole of lamps 4, the right one is connected to the negative pole. The support frame 2 is hitched in the rectangle hanging hole 13 of the electric display column 1 by the hanging arm 21, you just need move the movable plug 22 back and forth to make the electric copper 24 inserting or pulling out from the electric copper 24 of the electric display column 1, in order to turn on or off the lamps 4.

The said display shelf 3 is fixed on the support frame 2 by screws.

The Third Exemplary Embodiment

The electric display column 1 is a shape of square column, and includes grooves 14 and grids 15. The plastic strips 11 are installed in the grooves 14, the coppers 12 are installed inn the plastic strips 11, and they are connected to the power supply. There are multiple rectangular hanging holes distributing along the longitudinal direction of the grids 15; the two groups double grooves 14 and double grids 15, they are distributed symmetrically on both sides of the circular column 1 by ways of back to back.

One side of the support frame 2 is the double-hanging arms 21*a*, which consists of the two same hanging arms 21, the insulating plastic material movable double plugs 22*c* are fixed in the double-hanging arms 21*a*; the other side of the support frame 2 is just with the double-hanging arms 21*a*. The lamps 4 are fixed on the bracket 25 of the support frame 2, and the wires are hided into the body of support frame 2. The top of the double-hanging arms 21*a* is installed a hook 26, the hook 26 is installed in the hanging hole 13 of the electric display column 1, and the middle part of the hanging arm 21 is installed the guide groove 23, which bottom is installed the positioning bolt 28. The movable double plugs 22*c* are fixed in the double-hanging arms 21*a*, the interior of the said movable double plugs 22*c* is inlaid with the electric copper 24, which is installed in the guide groove 23 of the double-hanging arms 21*a*, and they can be moved back and forth. There is a guide hole 27 on the corresponding position of the movable double plugs 22*c* and double-hanging arms 21*a*. The positioning bolt 28 is fixed in the guide hole 27, in order to connect the movable double plugs 22*c* and double-hanging arms 21*a*, the movable double plugs 22*c* can be moved back and forth in the limited range of the guide hole 27. The length of the guide hole 27 depends on if the electric copper 24 of the movable double plugs 22*c* can be full touched on and not to the electric copper 24 of electric display column 1. And the electric copper 24 of the left movable plug 22*a* is connected to the positive pole of lamps 4, the right one is connected to the negative pole. The support frame 2 is hitched in the rectangle hanging hole 13 of the electric display column 1 by the hanging arm 21, you just need move the movable plug 22 back and forth to make the electric copper 24 inserting or pulling out from the electric copper 24 of the electric display column 1 in order to turn on or, off the lamps 4.

The said display shelf 3 is fixed on the support frame 2 by screws.

Although a few exemplary embodiments of the present general inventive concept have been illustrated and described, it would be appreciated by those skilled in the art that changes may be made in these exemplary embodiments without departing from the principles and spirit of the general inventive concept, the scope of which is defined in the claims and their equivalents.

The invention claimed is:

1. A method for the electric display apparatus with a lighting system, comprising: electric display column (1), support frame (2), display shelf (3), lamps (4), plastic strips (11) and coppers (12); the said electric display column (1) includes grooves (14) and grids (15); the said plastic strips (11) are installed in the grooves (14), the said coppers (12) are installed in the plastic strips (11) and they are connected to the power supply, there are multiple rectangular hanging holes (13) distributing along the longitudinal, direction of the grids (15); both ends of the said support frame (2) are installed the hanging arms (21), which top is installed a hook (26), the hook (26) is installed in the hanging hole (13) of the electric display column (1), and the middle part of the hanging arm (21) is installed the guide groove (23), which bottom installed the positioning bolt (28); the movable plug (22) is fixed in the hanging arms (21), the interior of the said movable plug (22) inlaid with the electric copper (24), which is installed in the guide groove (23) of the hanging arm (21), there is a guide hole (27) on the corresponding position of the movable plug (22) and hanging arm (21), the positioning bolt (28) is fixed in the guide hole (27), the left movable plug (22*a*) is connected to the positive pole of lamps (4), the right one (22*b*) is connected to the negative pole; the said display shelf (3) is fixed to the support frame (2) by the screw connection.

2. The method according to claim 1, wherein the electric display column (1) is a shape of circular column, the two groups double grooves (14) and double grids (15), they are distributed symmetrically on both sides of the circular column (1) by ways of back to back; one side of the support frame (2) is the double-hanging arms (21*a*), the insulating plastic material movable double plugs (22*c*) are fixed in the double-hanging arms (21*a*); the other side of the support frame (2) is just with the double-hanging arms (21*a*).

3. The method according to claim 1, wherein the electric display column (1) is a shape of square column, the two groups double grooves (14) and double grids (15), they are distributed symmetrically on both sides of the circular column (1) by ways of back to back; One side of the support frame (2) is the double-hanging arms (21*a*), the insulating plastic material movable double plugs (22*c*) are fixed in the double-hanging arms (21*a*); the other side of the support frame (2) is just with the double-hanging arms (21*a*).

4. The method according to claim 1, wherein the fixed panel (52) will be fixed on the wall at first, the electric display column (1) is fixed on the fixed panel (52); the electric display column (1) is a shape of inverted mountain type strip, the electric display column (1) is installed the bayonet (54), and the display panel (51) is equipped the flange collar (53), the display panel (51) is clamped and fixed on the electric display panel (51) by the flange collar (53) and bayonet (54).

5. The method according to claim 4, wherein the electric display column (1) is included the two groups double grooves (14) and double grids (15), corresponding the double hanging arms (21*a*) and the movable double plugs (22*c*).

6. The method according to claim 4, wherein the electric display column (1) is included the two groups double grooves (14) and double grids (15), corresponding one hanging arm equipped the left movable plug (22*a*) and the other hanging arm (21) equipped the right movable plug (22*b*).

* * * * *